US011353247B2

(12) United States Patent
Bernhardt et al.

(10) Patent No.: US 11,353,247 B2
(45) Date of Patent: Jun. 7, 2022

(54) REFRIGERANT COMPRESSOR SYSTEM WITH LEAKAGE CONTROL FOR A CONTROL HOUSING

(71) Applicant: BITZER Kuehlmaschinenbau GmbH, Sindelfingen (DE)

(72) Inventors: Florian Bernhardt, Horb am Neckar (DE); Jan Revellin, Gaeufelden (DE)

(73) Assignee: BITZER Kuehlmaschinenbau GmbH, Sindelfingen (DE)

( * ) Notice: Subject to any disclaimer, the term of this patent is extended or adjusted under 35 U.S.C. 154(b) by 28 days.

(21) Appl. No.: 16/833,543

(22) Filed: Mar. 28, 2020

(65) Prior Publication Data

US 2020/0224940 A1 Jul. 16, 2020

Related U.S. Application Data

(63) Continuation of application No. PCT/EP2017/075229, filed on Oct. 4, 2017.

(51) Int. Cl.
*F25B 31/02* (2006.01)
*F25B 49/02* (2006.01)

(52) U.S. Cl.
CPC ..... *F25B 31/02* (2013.01); *F25B 49/02* (2013.01); *F25B 2400/12* (2013.01); *F25B 2500/222* (2013.01)

(58) Field of Classification Search
CPC ..... F25B 2400/12; F25B 2500/222; F25B 31/02; F25B 49/02
See application file for complete search history.

(56) References Cited

U.S. PATENT DOCUMENTS 5,114,447 A * 5/1992 Davis ..... B01D 39/2034 55/485
6,536,225 B1 * 3/2003 Yajima ..... F24F 1/022 62/407
6,619,059 B1 * 9/2003 Johnson, Sr. ..... F24F 1/06 62/171

(Continued)

FOREIGN PATENT DOCUMENTS

JP H08200904 A 8/1996
JP 2005308328 A 11/2005

(Continued)

*Primary Examiner* — Henry T Crenshaw
(74) *Attorney, Agent, or Firm* — Reinhart Boerner Van Deuren P.C.

(57) ABSTRACT

In order to improve safety in a refrigerant compressor system comprising a refrigerant compressor and an electric drive motor for driving the refrigerant compressor, and, arranged in a protected manner in an interior of a control housing, a control electronics system, comprising electric components or electronic power components, for controlling the electronic drive motor, it is proposed that, during operation of the refrigerant compressor system with combustible refrigerant, the control housing is provided with a refrigerant drain, which does not impair at least one protection criterion of the control housing, for discharging refrigerant which enters the interior due to a refrigerant leakage, said refrigerant drain causing the refrigerant entering into the interior due to the refrigerant leakage to pass out of the interior into the surroundings of the refrigerant compressor system.

14 Claims, 6 Drawing Sheets

(56) References Cited

U.S. PATENT DOCUMENTS

| | | | | |
|---|---|---|---|---|
| 2005/0076671 | A1* | 4/2005 | Bae | F24F 1/0057 62/426 |
| 2007/0274858 | A1* | 11/2007 | Childers | A61L 2/208 422/28 |
| 2008/0278918 | A1* | 11/2008 | Tominaga | B62D 5/0406 361/719 |
| 2009/0107157 | A1 | 4/2009 | Dube | |
| 2012/0318139 | A1* | 12/2012 | Mao | B01D 39/1661 95/116 |
| 2013/0247603 | A1* | 9/2013 | Margotti | F25B 47/006 62/222 |
| 2014/0093971 | A1* | 4/2014 | Norton | G01N 33/0032 436/136 |
| 2015/0233622 | A1* | 8/2015 | Yajima | F25B 49/005 62/129 |
| 2019/0203998 | A1* | 7/2019 | Crane | F25B 49/022 |
| 2020/0072508 | A1* | 3/2020 | Uraguchi | F25B 1/00 |
| 2021/0193803 | A1* | 6/2021 | Kato | H01L 29/7393 |

FOREIGN PATENT DOCUMENTS

| | | | |
|---|---|---|---|
| JP | 2007285544 | A | 11/2007 |
| JP | 2008101862 | A | 5/2008 |
| JP | 2008116123 | A | 5/2008 |
| JP | 2008281286 | A | 11/2008 |
| JP | 2009-222009 | * | 10/2009 |
| JP | 2016191504 | A | 11/2016 |
| WO | WO 2013/139909 | A1 | 9/2013 |

* cited by examiner

REFRIGERANT COMPRESSOR SYSTEM WITH LEAKAGE CONTROL FOR A CONTROL HOUSING

CROSS-REFERENCE TO RELATED PATENT APPLICATION

This application is a continuation of International application number PCT/EP2017/075229 filed on Oct. 4, 2017.

This patent application claims the benefit of International application No. PCT/EP2017/075229 of Oct. 4, 2017, the teachings and disclosure of which are hereby incorporated in their entirety by reference thereto.

BACKGROUND OF THE INVENTION

The invention relates to a refrigerant compressor system comprising a refrigerant compressor and an electric drive motor for driving the refrigerant compressor, and, arranged in a protected manner in an interior of a control housing, a control electronics system, comprising electric components or electronic power components, for controlling the electronic drive motor.

In this case, a control electronics system may be a simple motor protection unit, which for example monitors a temperature of the drive motor and switches off the drive motor if the temperature is too high.

In a refrigerant compressor system of this kind there is the risk that refrigerant might enter an interior of the control housing as a result of refrigerant leakages, thus leading to safety problems.

The object of the invention is therefore to improve the safety of a refrigerant compressor system of this kind.

SUMMARY OF THE INVENTION

In accordance with the invention, this object is achieved in the case of a refrigerant compressor system of the kind described at the outset in that, during operation of the refrigerant compressor system with combustible refrigerant, the control housing is provided with a refrigerant drain, which does not impair at least one protection criterion of the control housing, for discharging refrigerant which enters into the interior due to a refrigerant leakage, said refrigerant drain causing the refrigerant entering into the interior due to the refrigerant leakage to pass out of the interior into the surroundings of the refrigerant compressor system.

The advantage of the solution according to the invention can thus be considered that of ensuring, by the refrigerant drain, that the refrigerant entering the interior due to refrigerant leakage passes out of the interior again through the refrigerant drain.

Since the refrigerant passes out from the interior, a simple possibility is also provided for detecting, outside the control housing, the refrigerant that has passed out.

The at least one protection criterion of the control housing is dust-tightness, that is to say the control housing prevents the infiltration of dust into the interior.

A further protection criterion is preferably tightness of the control housing with respect to liquids penetrating into the interior from outside the interior.

The solution according to the invention has proved to be particularly advantageous if refrigerant-conveying components are provided in the control housing or if the control housing is directly adjacent to refrigerant-conveying components.

No further details have yet been provided in respect of the arrangement of the refrigerant drain.

In accordance with an advantageous solution, the refrigerant drain leads into a spatial region of the interior in which the refrigerant collects as a result of the effect of gravity.

In other words, if the refrigerant collects as a result of the effect of gravity in an upper area of the interior owing to the lower density of the refrigerant, the refrigerant drain is associated with the upper area and leads into this area.

Since the combustible refrigerants usually have a higher density than air, it is preferably provided that the spatial region of the interior with which the refrigerant drain is associated is a spatial region arranged lowest in the direction of the force of gravity, and the refrigerant drain thus leads into this spatial region.

With regard to the construction of the control housing, no further details have yet been provided in conjunction with the previous explanation of the solution according to the invention.

In accordance with an advantageous solution, housing parts of the control housing are connected to one another tightly in respect of condensed liquids and in a dust-tight manner so as to uphold the protection criteria associated with said housing parts, such that it is not possible for a significant gas flow to form in the region of the connection of the housing parts to one another, and also no dust can pass through.

No further details have yet been provided in respect of the construction of the refrigerant drain either; it has merely been defined that the refrigerant drain must also meet the protection criteria associated with the control housing.

To do this, it is provided advantageously that the refrigerant drain of the control housing has a filter element through which refrigerant that spreads within the interior passes.

In particular the filter element of the refrigerant drain is constructed so that it permits a passage of gas, but the passage of dust particles is prevented, such that the at least one protection criterion requiring an interior protected against infiltration of dust particles may be maintained by the refrigerant drain.

It is even more advantageous if the filter element is additionally also protected against the infiltration of liquids into the interior.

In order to discharge condensed liquids, in particular condensed water, from the interior of the control housing, it is preferably provided that the filter element allows condensed water to leave the interior.

In this case, the filter element is expediently semi-permeable, that is to say it allows condensed liquids to leave the interior, but does not allow dust to enter the interior.

With regard to the construction of the filter element, it would appear conceivable, for example, to provide this in the form of a filter mat or a filter membrane.

The filter element is preferably constructed such that it filters out particles that are larger than 100 μm, better still filters out particles that are larger than 50 μm.

A particularly advantageous solution, however, provides that the filter element is formed as a sintered body, which in itself is a stiffer body and therefore is easily fixable in the refrigerant drain.

Instead of a sintered body, however, it is also conceivable to provide a labyrinth body.

No further details have yet been provided with regard to the type of refrigerant cooling of the control electronics system.

In accordance with an exemplary solution, a refrigerant-operated cooling unit for the control electronics system is arranged in the interior of the control housing.

The arrangement of a refrigerant-operated cooling unit of this kind thus already creates the risk that a refrigerant leakage may occur in the region of this refrigerant-operated cooling unit.

The risk is even higher if refrigerant-conveying components for supplying the refrigerant-operated cooling unit are arranged in the control housing.

Refrigerant-conveying components of this kind are, for example, components of a control cooling branch, such as connection lines, on-off valves, control valves, temperature sensors, and throttles.

The danger of a refrigerant leakage, however, exists also if the interior of the control housing is adjacent, in particular directly adjacent, to the housing of the compressor unit and the housing is provided with electrical line feed-throughs leading into the interior of the control housing, and thus there is a danger of a leakage in particular in the region of electrical line feed-throughs or sensors or control valves.

In addition, the invention relates to a refrigeration system comprising a refrigerant compressor system according to one of the above features, wherein, in accordance with the invention, the refrigerant compressor system is arranged in a closed or non-closed facility space, in particular in a facility space that is open on all sides, in which facility space any escape of refrigerant is monitored.

A monitoring of this kind in respect of escaping refrigerant is performed, for example in the case of a non-closed facility space, by a transportable refrigerant testing device or by a sensor arranged in the vicinity of the refrigerant drain.

It is particularly favourable, however, if a refrigerant leakage warning device is associated with the facility space and if the refrigerant leakage warning device continuously monitors the facility space, in particular a closed facility space, by means of a refrigerant sensor.

It is advantageously provided that the refrigerant warning device generates a warning signal if a safety-relevant refrigerant concentration is exceeded in the facility space, which warning signal for example may be an optical, acoustic or electronic signal, or may be a warning signal forwarded by means of a data transfer.

Further features and advantages of the invention are the subject of the following description and the presentation in the drawings of a number of exemplary embodiments.

DETAILED DESCRIPTION OF THE INVENTION

Figure 1:
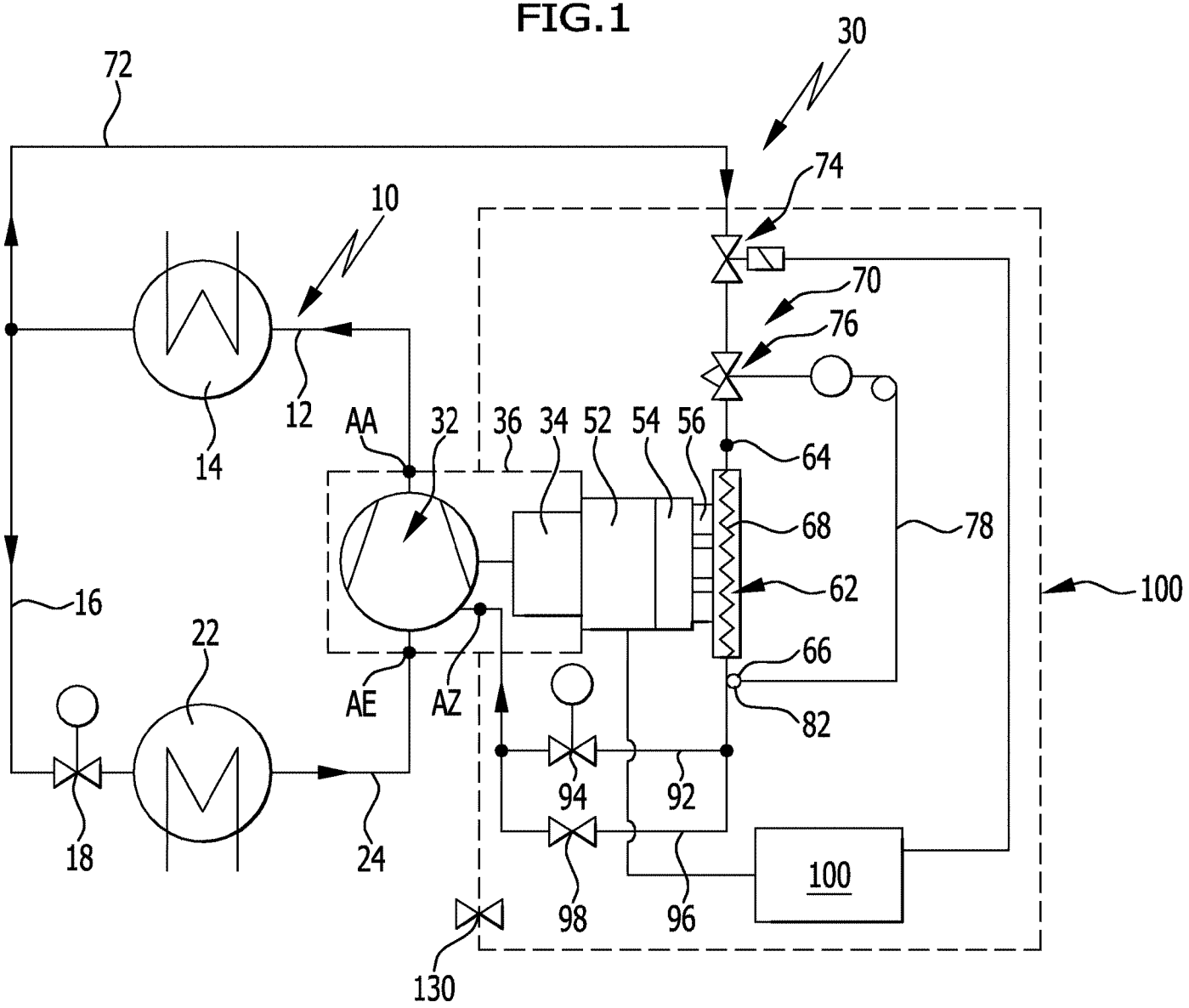
FIG. 1 shows a schematic depiction of a first exemplary embodiment of a refrigerant compressor system according to the invention.

In a refrigerant circuit shown in FIG. 1 and denoted as a whole by 10, there is provided a refrigerant compressor system denoted as a whole by 30 and comprising a refrigerant compressor 32, which delivers compressed refrigerant to an output connection AA, which is in turn connected via a first connection line 12 to a high-pressure-side heat exchanger unit 14, in which the refrigerant, which is under high pressure, is cooled, for example liquefied.

This cooled, for example liquefied refrigerant is fed via a second connection line 16 to an expansion member denoted as a whole by 18, in which the refrigerant cooled by the high-pressure-side heat exchanger 14 is expanded, with the refrigerant then entering a low-pressure-side heat exchanger 22, in which it is able to take on heat, for example evaporate, as a result of having been cooled by expansion in the expansion member 18.

Figure 2:
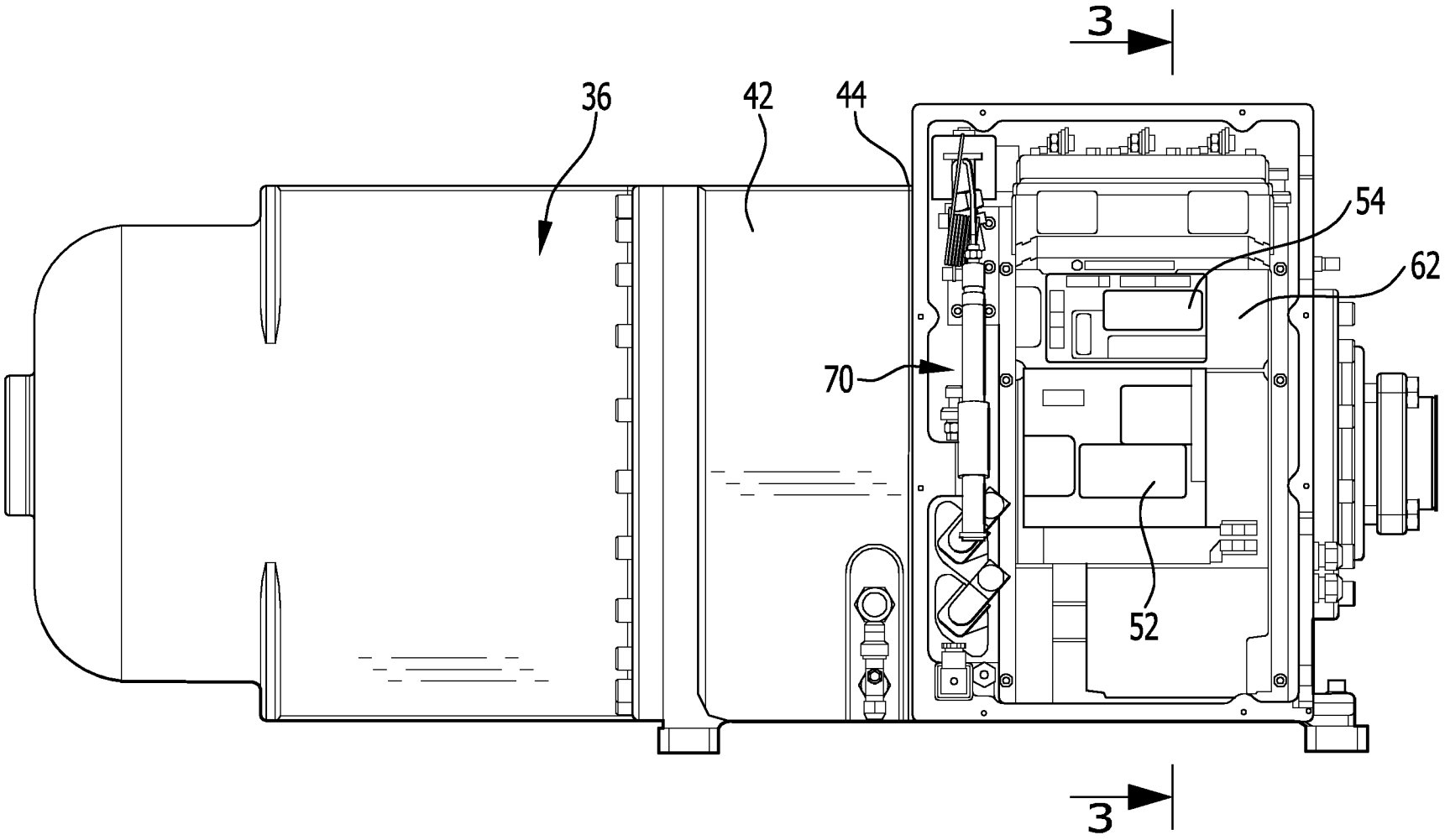
FIG. 2 shows a depiction of an actual embodiment of the refrigerant compressor system.

The refrigerant compressor 32 is preferably driven by an electric motor 34, and in particular the refrigerant compressor 32 and the electric motor 34 are arranged in an overall housing 36, as shown in FIG. 2, which on the one hand has a compressor housing 42 for receiving the refrigerant compressor 32 and on the other hand has a motor housing 44 for receiving the electric drive motor 34, these housings being connected to one another.

The drive motor 34 is preferably controllable in speed-regulated fashion by means of a motor control 52, the motor control 52 comprising an electronic speed control 54, in particular a variable-frequency drive, which has heavily temperature-loaded electronic power components 56, which during operation of the electric drive motor 34 with the motor control 52 experience a high heat build-up, and in particular if they experience excessive heating during operation of the electric drive motor 34 have a reduced service life.

For this reason—as is described by way of example in WO 2013/139909 A1—a heat sink 62 is provided for the cooling of the electronic power components, and the heavily loaded electronic power components can dissipate the heat that has been created within them to said heat sink.

The heat sink 62, to this end, is actively coolable with refrigerant conducted in the refrigerant circuit 10 and to this end has an input connection 64 and an output connection 66, a cooling channel 68 conveying the refrigerant passing through the heat sink 52 from the input connection 64 to the output connection 66.

The heat sink 62 is part of a control cooling branch which is denoted as a whole by 70 and which comprises a branch line 72, which branches off the refrigerant from the second connection line 16 and feeds it to an on-off valve 74 of the control cooling branch 70, which switches on the refrigerant feed to the control cooling branch 70 in order to cool the heat sink 62.

The on-off valve 74 is followed by a thermostatic expansion valve 76 of the control cooling branch 70, which expansion valve is arranged between the input valve 74 and the input connection 64 of the heat sink 62 and is connected by means of a capillary tube 78 to a temperature sensor 82 at the output connection 66 of the heat sink.

The expansion valve 76, in particular formed as a thermostatic expansion valve, thus controls the cooling performance in the heat sink 62 in accordance with the temperature measured by means of a temperature sensor 82 at the output connection 66 of the heat sink 62.

The output connection 66 is also connected, by means of a connection line 92 of the control cooling branch 70 in which there is arranged an evaporation pressure controller 94, to an intermediate pressure connection AZ of the refrigerant compressor 32, such that an evaporation pressure in the heat sink 62 is higher than an intake pressure of the refrigerant compressor 32 of the refrigerant circuit 10, even without the control effect of the evaporation pressure controller 94.

Since the thermostatic expansion valve 76 is not controllable externally, the on-off valve 74 is provided in order to switch off the control cooling branch 70 and is controllable by way of a control system 100 by means of the motor control 52.

In addition, a throttle 98 arranged in a bypass line 96 of the control cooling branch 70 is also arranged in parallel with the evaporation pressure controller 94, which throttle, when the refrigerant compressor is running, prevents an undesirable heating of the electronic power components 56, as also described in WO 2013/139909 A1.

Figure 3:
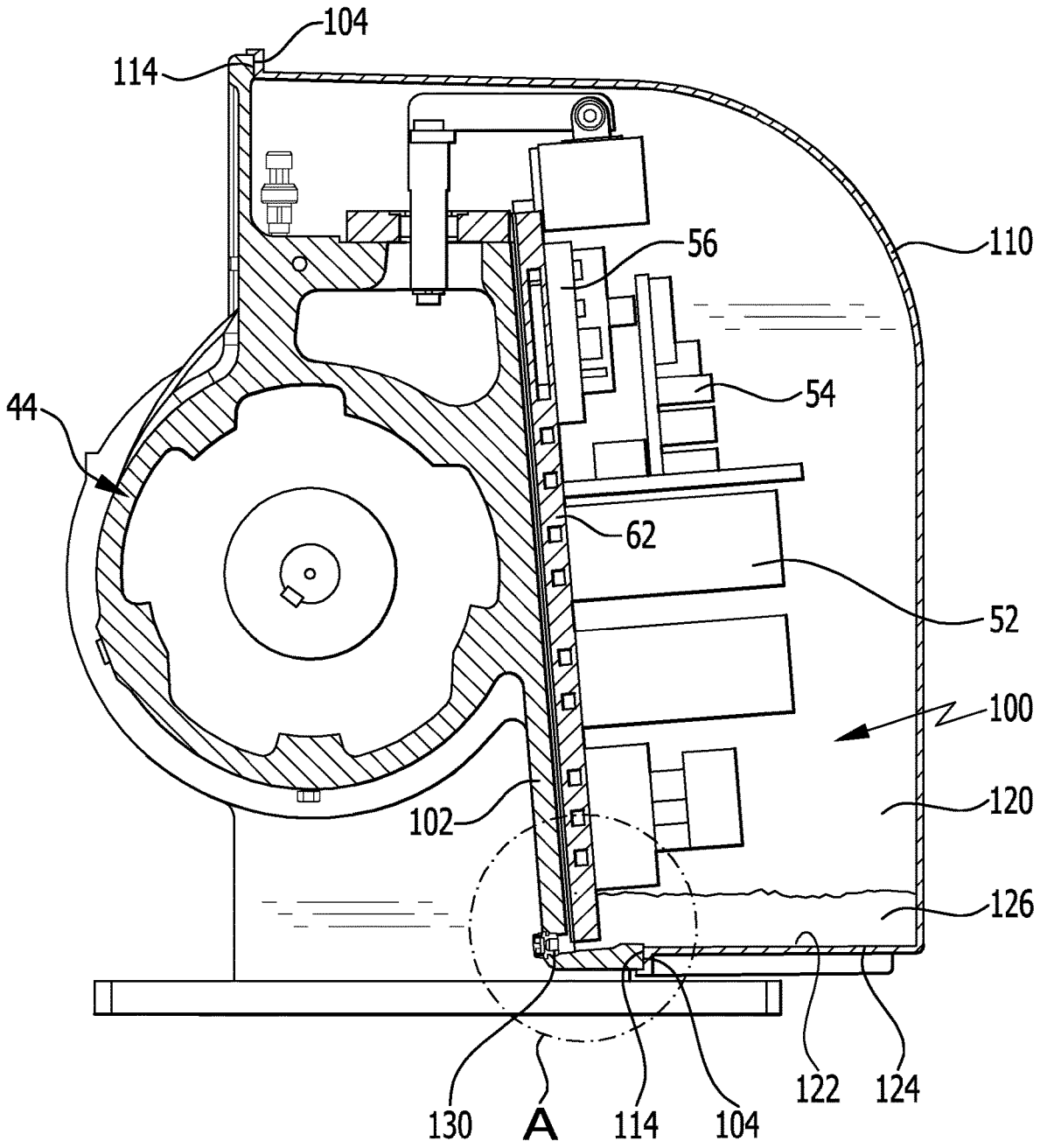
FIG. 3 shows a section along line 3-3 in FIG. 2.

As shown in FIGS. 2 and 3, all of these components of the control branch 70, together with the electronic power components 56, are arranged in a control housing, which is mounted on the overall housing 36, for example on the motor housing 44 or optionally also on the compressor housing 42, and which is denoted as a whole by 100 and is formed on the one hand by a base unit 102, which is held on the overall housing 36 and for example carries the heat sink 62, on which the motor control 52, the variable-frequency drive 54 and in particular the electronic power components 56, in particular of the variable-frequency drive 54, are arranged so as to be cooled.

The base unit 102 in turn comprises a mounting flange 104, which runs peripherally in a closed manner around the base unit and on which a housing cap 110 can be placed, the housing cap 110 likewise being provided with a peripheral flange region 114, which can be placed onto the mounting flange 104 of the base unit and thus tightly seals off an interior 120, in which for example the control cooling branch 70 and the motor control 52 with the variable-frequency drive 54 and the electronic power components 56 are arranged, with respect to the surroundings of the refrigerant compressor system 30 and for example with respect to mechanical impacts, corrosion, corrosive solutions, mould, insects, solar radiation, icing, dust and condensed liquids, such that in particular the motor control 52, the variable-frequency drive 54 and the electronic power components 56 as well as all components of the control cooling branch 70 are protected against harmful external influences of this kind.

A construction of this kind, however, of the control housing has the disadvantage that, if combustible refrigerant is used, for example the refrigerants that are hardly flammable or flammable or highly flammable, for example in accordance with ISO817 from 2014, a refrigerant leakage of all refrigerant-conveying components in the interior 120 of the control housing 100 might lead in conjunction with the oxygen present in the interior 120 to the creation of a combustible gas mixture, or even a gas mixture that is at risk of explosion.

For this reason it is necessary to form the control housing 100 such that refrigerant escaping in the event of a refrigerant leakage passes out from the interior 120.

Figure 4:
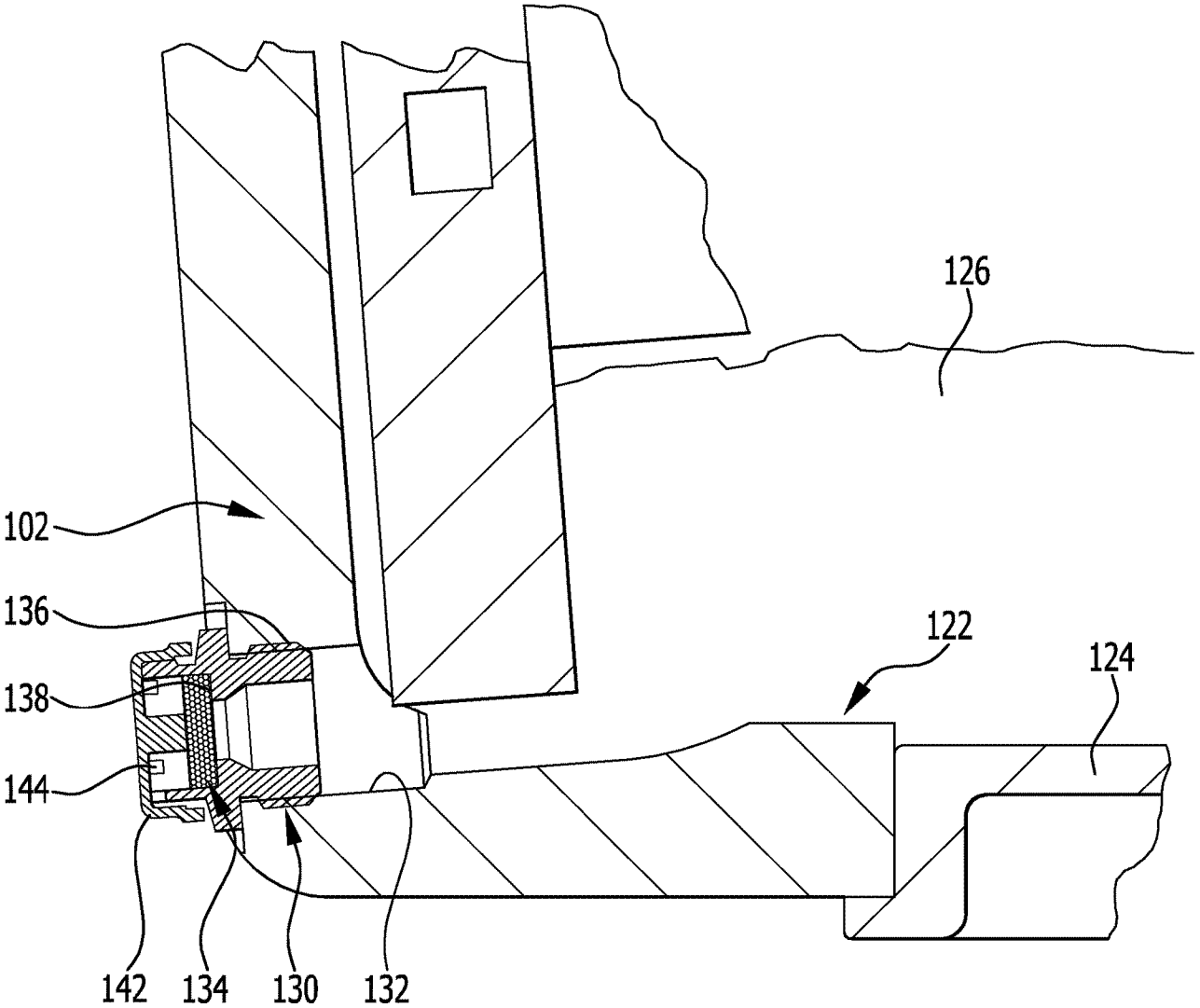
FIG. 4 shows an enlarged view of the detail of a region A in FIG. 3.

If, for example, the refrigerant has a specific weight, which causes refrigerant to sink in the interior 120 in the direction of the force of gravity and to form an accumulation of refrigerant 126 in the region of an area 122 that is lowest in the direction of the force of gravity, for example above a base 124, this area 122 is thus associated with a refrigerant drain 130, which has a drain channel 132 branching off from the area 122 that is lowest (FIG. 4), which drain channel for example passes through the base unit 102 and additionally has a filter element 134 arranged in the drain channel 132, which filter element for example is constructed as a sintered filter body that is stiff in itself and on the one hand makes it possible to reliably divert the gaseous refrigerant from the accumulation of refrigerant 126, but on the other hand prevents an infiltration of dust and liquids, for example in the form of liquid droplets.

It is preferably provided that the filter element 134 filters out particles having a size of more than 100 μm, better still particles having a size of more than 50 μm.

A sleeve 136 that can be screwed into the drain channel 132 is preferably provided for mounting of the filter element and forms a support 138 for the filter element 134, and a cover 142 can be screwed onto the sleeve, which cover abuts on the support 138 and is provided with air exchange openings 144.

With a refrigerant drain 130 of this kind it is possible to reliably remove refrigerant from the accumulation of refrigerant 126 from the interior 120, such that said refrigerant passes out into the surroundings of the refrigerant compressor system 30.

The discharge of the refrigerant from the interior 120 is additionally also supported as follows: a refrigerant leakage in the region of the refrigerant-conveying elements in the interior 120 represents a gas feed to the interior, which gas feed in particular is usually continuous, and therefore, in particular if a positive pressure is to be avoided in the interior 120, it is necessary to drain off the fed gas volume, which is achieved by means of the refrigerant drain 130, which therefore, on account of the gas feed to the interior 120, has to continuously discharge gas as well from the interior 120, this gas necessarily being refrigerant on account of the fact that the accumulation of refrigerant 126 forms in the lowest area 122.

Figure 5:
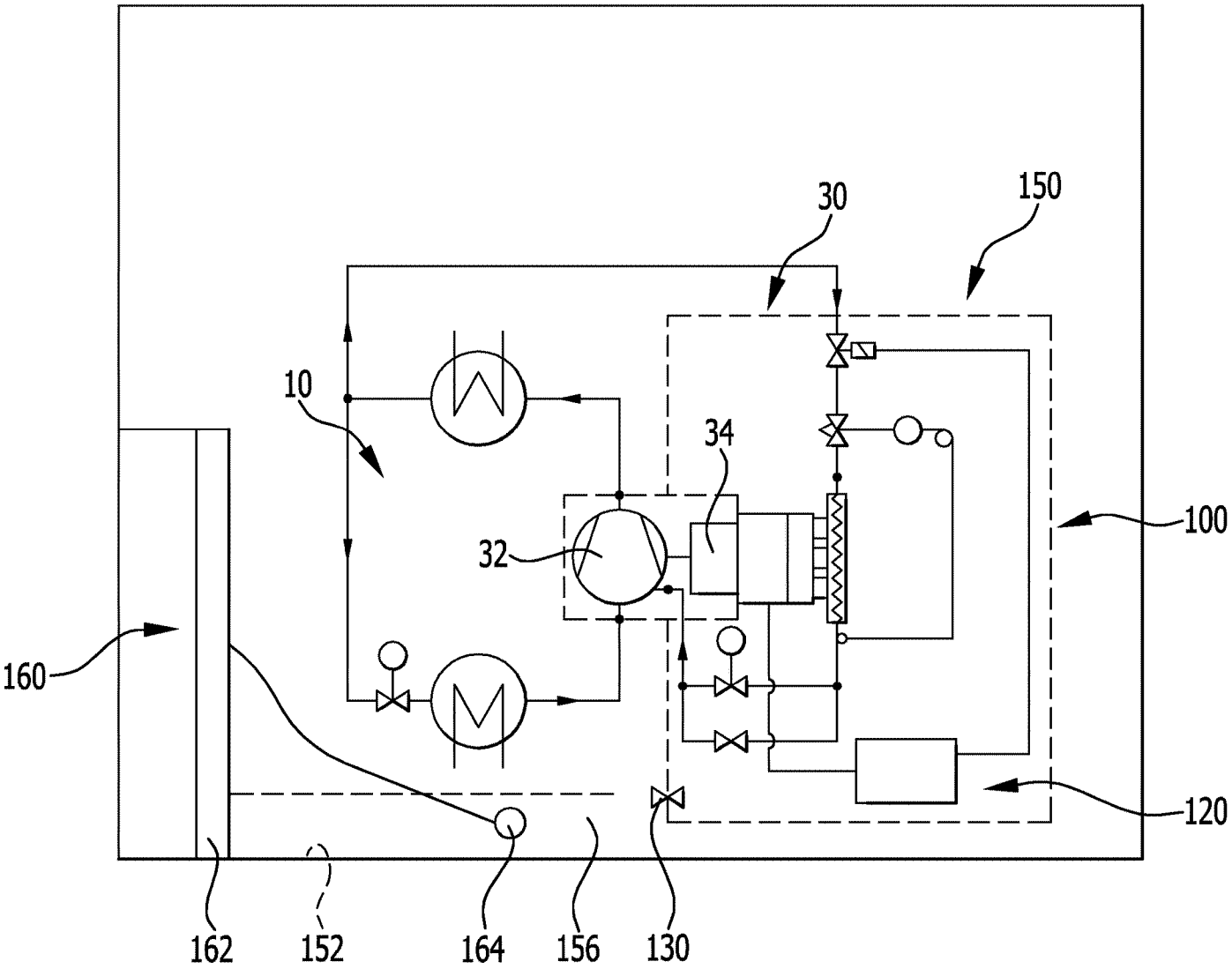
FIG. 5 shows a schematic depiction of a refrigerant compressor system as a component of a refrigeration system arranged in a facility space.

If a refrigerant compressor system 30 (FIG. 5) is arranged for example together with the refrigerant circuit 10 in a facility space 150 of a refrigeration system, and if there is a refrigerant leakage in the control housing 120, on account of the refrigerant drain 130 the refrigerant entering the interior 120 of the control housing due to the refrigerant leakage passes out of the interior again through the refrigerant drain 130 and thus enters the facility space 150, which surrounds the refrigerant compressor system 30.

An accumulation of refrigerant 156, which likewise, again, can be detected by a refrigerant sensor 164 of a system control 160 having a refrigerant leakage warning device 160, thus forms likewise in the facility space 150, more specifically in an area 152 of the facility space 150 that is the lowest area in the direction of the force of gravity, the refrigerant leakage warning device 162 measuring the concentration of the refrigerant in the air in the facility space 150 and generating a warning signal in the event that a defined threshold value is exceeded.

Since, at the same time, the refrigerant circuit 10 is also arranged in the facility space 150, the system control 160 is thus both able to identify a refrigerant leakage in the refrigerant circuit 10 and also a refrigerant leakage in the control housing 100 of the refrigerant compressor system 30, such that safer operation both of the refrigerant circuit and of the refrigerant-conveying components arranged in the control housing 100 is thus possible, without the possibility of a combustible or explosive gas mixture forming in the interior 120 of the control housing 100 or in the facility space 150.

Figure 6:
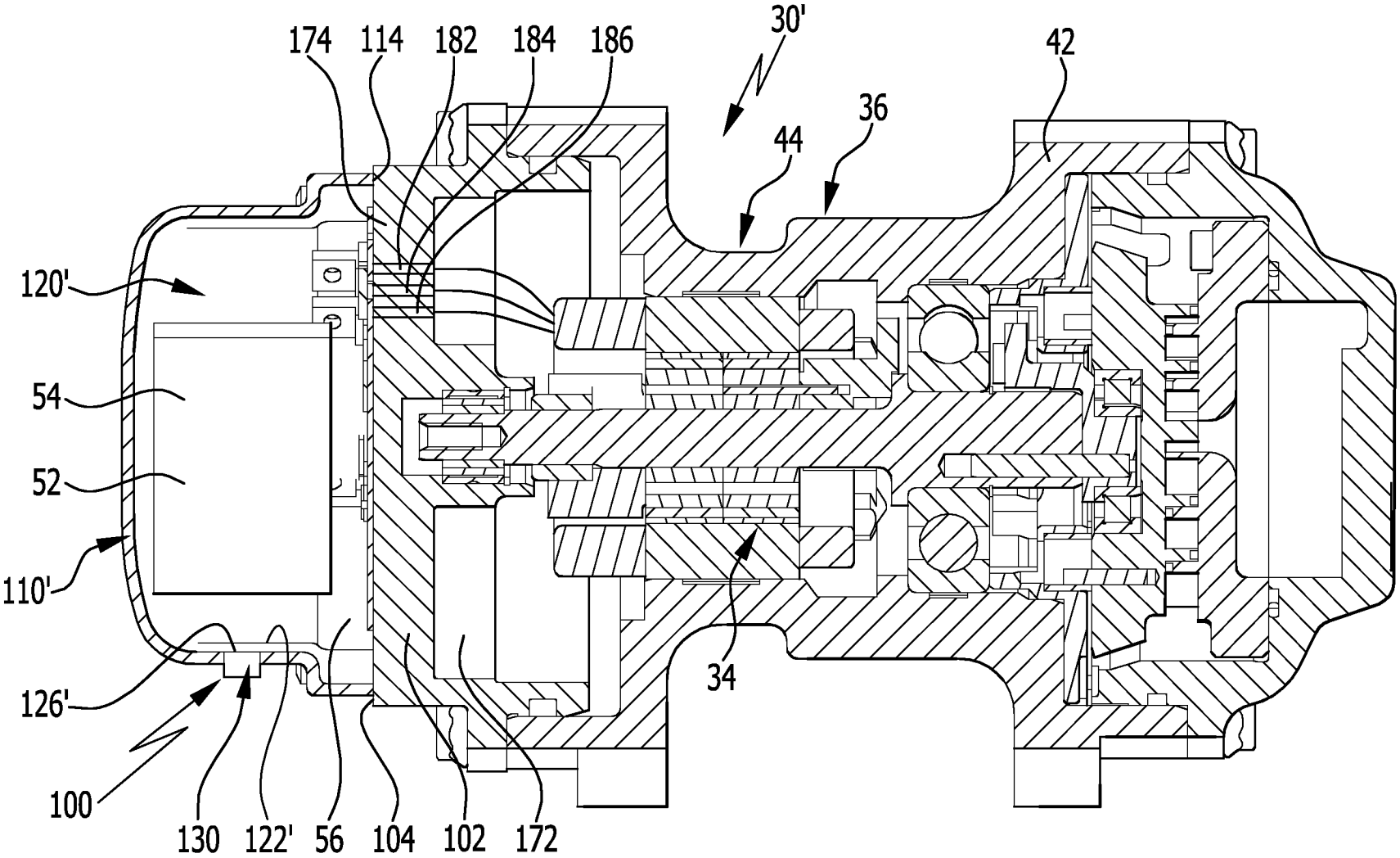
FIG. 6 shows a longitudinal section through a second exemplary embodiment of a refrigerant compressor system according to the invention.

In a second exemplary embodiment of a refrigerant compressor system 30' according to the invention, shown in FIG. 6, the overall housing 36 likewise comprises a compressor housing 42 and a motor housing 44, and in this case a scroll compressor for example is arranged in the compressor 42.

In this case, refrigerant guided to the scroll compressor passes through the electric drive motor 34 arranged in the motor housing 44 and preferably enters an inflow space 172 of the motor housing 44, which is arranged on a side of the electric drive motor 34 opposite the scroll compressor and is adjacent to a housing wall 174, which for example is an end-face housing wall and which at the same time constitutes the base unit 102 for the control housing 100.

In this exemplary embodiment as well, the base unit 102 of the control housing 100 comprises the peripheral mounting flange 104, on which the housing cap 110 sits by means of a flange region 114 and terminates tightly therewith, such that the interior 120 of the control housing 100 is protected from the surrounding environment and for example from mechanical impacts, corrosion, corrosive solutions, mould, insects, solar radiation, icing, dust and condensed liquids, similarly to the way in which this is achieved in the first exemplary embodiment.

In this exemplary embodiment as well, the motor control 52 is located in the control housing 100 with the variable-frequency drive 54 comprised by the motor control, and the electronic components 56 of the inverter sit directly on the base unit 102, which at the same time constitutes the housing wall 174 of the motor housing 44 and is cooled by the refrigerant fed to the inflow space 172.

There are thus no refrigerant-conveying components present in the interior 120' of the control housing 110'.

One or more, generally three, electrical feed-throughs 182, 184, 186, however, or an element combining a plurality of feed-throughs to form a unit and installed as a unit of this kind, are provided in the housing wall 174, and are necessary in order to create an electrical connection between the variable-frequency drive 54 of the motor control 52 and the electric drive motor 34.

There is also the risk of a refrigerant leakage in the region of electrical feed-throughs 182, 184 and 186 of this kind, such that refrigerant may pass from the inflow space 172, along the electrical feed-throughs 182, 184, 186, into the interior 120' of the control housing 110', whereby, with use of a combustible refrigerant in the interior 120', a combustible or even explosive gas mixture may likewise be formed in the interior 120'.

For this reason, in this exemplary embodiment as well, a refrigerant drain 130 is provided in the area 122' of the interior 120 that is lowest in the direction of the force of gravity, which refrigerant drain is constructed and formed in the same way as in the first exemplary embodiment and causes the refrigerant collecting in the accumulation of refrigerant 126' in the lowest area 122' due to the refrigerant leakage to be discharged from the interior 120' by means of the refrigerant drain 130 and into the surroundings of the refrigerant compressor system 30'.

If a refrigeration system 30' of this kind is arranged in the facility space 150, similarly to in the first exemplary embodiment, refrigerant entering the interior 120' of the control housing 110' as a result of a refrigerant leakage is likewise also detectable in the facility space 150 by the system control 160 by means of the sensor 162.

In both exemplary embodiments, however, it is also possible to detect refrigerant escaping from the interior 120 or 120' using transportable detection devices and then to generate a warning signal or a warning message depending on the measured concentration.

The invention claimed is:

1. A refrigerant compressor system comprising:

a refrigerant compressor and an electric drive motor for driving the refrigerant compressor;

a control housing arranged in a manner to protect against dust or liquid, exterior to the control housing, from infiltrating an interior of the control housing, a control electronics system, comprising electric components or electronic power components, for controlling the electric drive motor;

wherein during operation of the refrigerant compressor system with a combustible refrigerant that flows through the electric components arranged in the control housing, the control housing is provided with a refrigerant drain, which does not impair at least one protection criterion of the control housing, for discharging refrigerant which enters into the interior due to a refrigerant leakage, said refrigerant drain causing the refrigerant entering the interior due to the refrigerant leakage to pass out of the interior into the surroundings of the refrigerant compressor system;

wherein the refrigerant drain leads into a spatial region of the interior in which the refrigerant collects as a result of the force of gravity.

2. A refrigerant compressor system in accordance with claim 1, wherein the spatial region of the interior is an area thereof arranged lowest in the direction of the force of gravity.

3. A refrigerant compressor system in accordance with claim 1, wherein housing elements of the control housing are connected to one another tightly in respect of liquids and dust so as to maintain the associated protection criteria.

4. A refrigerant compressor system comprising:

a refrigerant compressor and an electric drive motor for driving the refrigerant compressor;

a control housing arranged in a manner to protect against dust or liquid, exterior to the control housing, from infiltrating an interior of the control housing, a control electronics system, comprising electric components or electronic power components, for controlling the electric drive motor;

wherein during operation of the refrigerant compressor system with a combustible refrigerant that flows through the electric components arranged in the control housing, the control housing is provided with a refrigerant drain, which does not impair at least one protection criterion of the control housing, for discharging refrigerant which enters into the interior due to a refrigerant leakage, said refrigerant drain causing the refrigerant entering the interior due to the refrigerant leakage to pass out of the interior into the surroundings of the refrigerant compressor system;

wherein the refrigerant drain of the control housing has a filter element, through which refrigerant that spreads within the interior passes.

5. A refrigerant compressor system in accordance with claim 4, wherein the filter element of the refrigerant drain allows a passage of gas, but prevents the passage of dust particles.

6. A refrigerant compressor system in accordance with claim 4, wherein the filter element of the refrigerant drain allows a passage of gas, but prevents the entry of liquids into the interior.

7. A refrigerant compressor system in accordance with claim 6, wherein the filter element filters out particles that are larger than 100 μm.

8. A refrigerant compressor system in accordance with claim 6, wherein the filter element is formed as a sintered body.

9. A refrigerant compressor system in accordance with claim 1, wherein a refrigerant-operated cooling unit for the control electronics system is arranged in the interior of the control housing.

10. A refrigerant compressor system in accordance with claim 9, wherein refrigerant-conveying components for supplying the refrigerant-operated cooling unit are arranged in the control housing.

11. A refrigerant compressor system in accordance with claim 1, wherein the interior of the control housing is adjacent to a housing of the compressor, and in that the housing is provided with electrical line feed-throughs leading into the interior of the control housing.

12. A refrigeration system comprising a refrigerant compressor system in accordance with claim 1, wherein the refrigerant compressor system is arranged in a facility space, in which any escape of refrigerant is monitored.

13. A refrigeration system in accordance with claim 12, wherein a refrigerant leakage warning device is associated with the facility space, and in that the refrigerant leakage warning device continuously monitors the facility space by means of a refrigerant sensor.

14. A refrigeration system in accordance with claim 13, wherein the refrigerant leakage warning device generates a warning signal if a safety-relevant refrigerant concentration is exceeded in the facility space.

* * * * *